United States Patent [19]

Schärer

[11] Patent Number: 4,706,714

[45] Date of Patent: Nov. 17, 1987

[54] MOUNTING ARRANGEMENT FOR A SWITCHING UNIT FOR A LOOM

[75] Inventor: Bernhard Schärer, Ruti, Switzerland

[73] Assignee: Sulzer Brothers Limited, Winterthur, Switzerland

[21] Appl. No.: 937,213

[22] Filed: Dec. 3, 1986

[30] Foreign Application Priority Data

Dec. 4, 1985 [CH] Switzerland ..... 5157/85

[51] Int. Cl.[4] ..... D03D 51/04

[52] U.S. Cl. ..... 139/1 R; 139/336

[58] Field of Search..... 139/1 R, 336; 29/400 R, 29/592 R, 622, 729, 739

[56] References Cited

U.S. PATENT DOCUMENTS

| | | | |
|---|---|---|---|
| 3,373,773 | 3/1968 | Balentine et al. | 139/336 |
| 3,502,115 | 3/1970 | Barnett | 139/1 R |
| 4,307,275 | 12/1981 | Larson et al. | 29/622 |
| 4,624,049 | 11/1986 | Leuko | 29/622 |

*Primary Examiner*—Henry S. Jaudon

*Attorney, Agent, or Firm*—Kenyon & Kenyon

[57] ABSTRACT

The cross beam of the loom is provided with a retaining bar in which at least one panel-like or board-like switching unit is slidably mounted. Suitable acess openings are provided in the retaining bar to permit access to the control elements on the switching unit. Panel like spacing elements are employed to locate the respective switching units within the retaining bar and electrical plugs are provided for connecting the switching units to a flat cable extending along the cross beam.

14 Claims, 5 Drawing Figures

MOUNTING ARRANGEMENT FOR A SWITCHING UNIT FOR A LOOM

This invention relates to a mounting arrangement for a switching unit of a loom. More particularly, this invention relates to a method of mounting a switching unit on a loom.

As is known, looms generally are constructed with a drive system for the starting, stopping and control of the various operations of a loom as well as with a cross-beam which extends over a weaving width of the loom. In some cases, at least one electric or electronic switching unit having control elements has been mounted on the cross-beam for controlling the drive system. For example, it has been known to provide a cross beam with three such switching units, each individually mounted in a separate mount. In addition, each mount has been secured individually to the cross-beam. However, in these arrangements, each of the switching units must be assembled separately from the loom, then secured individually in the appropriate operating position on the cross-beam. Thus, fitting of these switching units requires a correspondingly extra expenditure on pre-assembly and/or assembly.

Accordingly, it is an object of the invention to reduce the assembly costs of a loom.

It is another object of the invention to provide a simplified mounting for the switching units of a loom.

It is another object of the invention to provide a simplified technique for mounting a switching unit on a loom.

It is another object of the invention to ensure a reliable location of a switching unit and a connection of the switching unit to a drive system of a loom.

It is another object of the invention to reduce the time required to mount a switching unit on a loom for the control of the drive system of the loom.

Briefly, the invention provides a guide member for mounting on the cross-beam of a loom, at least one switching unit which is displaceably guided within the guide member and which has a plurality of control elements for controlling the loom and means for locating the switching unit within the guide member.

In addition, the switching unit cooperates with a connecting cable which extends along the cross-beam, for example being disposed within a fitting space between the cross-beam and a switching unit. In this respect, the cable is connected to a drive system for operating the loom and a connecting element is provided for connecting the switching unit to the cable when the switching unit is in a selected operating position.

The mounting arrangement permits the use of ready-for-assembly switching units, for example in the form of printed circuits which are of very simple construction and correspondingly low costs. Such switching units have integrated control elements so as to avoid any need for pre-assembly of the switching units. Thus, the switching units can be arranged directly on the guide member and can be simply moved into a predetermined operative position and secured in place. This leads to substantial savings in cost and labor.

In accordance with the invention, a method of mounting a switching unit having control elements for a drive system is also provided. In this regard, the method comprises the steps of mounting a switching unit in a guide member which extends over a weaving width of the loom, of moving the switching unit along the guide member into an operative position, of securing the switching unit in the operative position, of connecting the switching unit to the drive system, for example via the connecting cable, and of mounting the guide member on a cross-beam of the loom.

One or more switching units can thus be disposed in an independently variable operative position in a rational manner, particularly, without the use of screws.

These and other objects and advantages of the invention will become more apparent from the following detailed description taken in conjunction with the accompanying drawings wherein.

Figure 1:
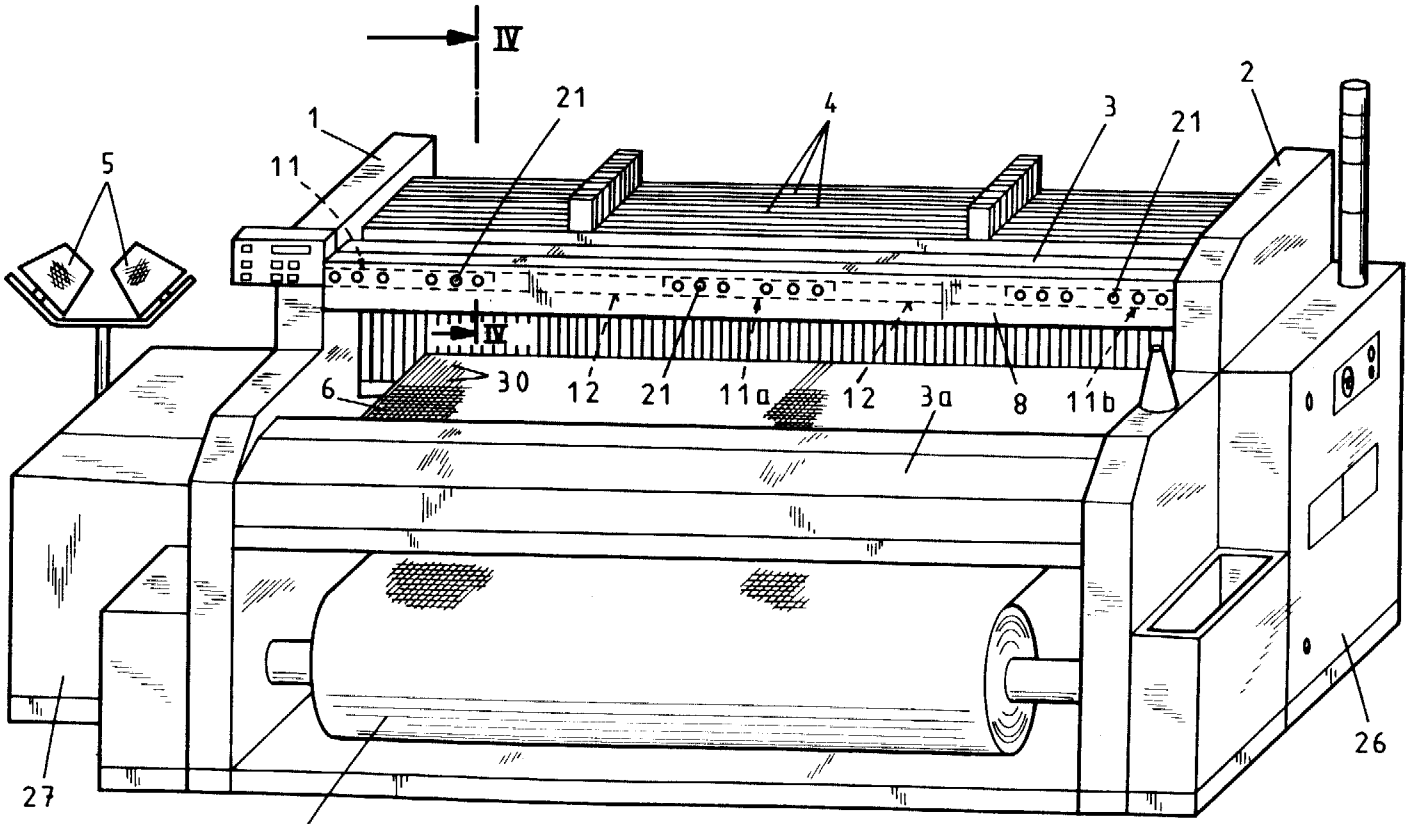
FIG. 1 illustrates a perspective view of a cloth end of a loom constructed in accordance with the invention.

Referring to FIG. 1, the loom includes a frame having a pair of side uprights 1, 2 which are interconnected by two cross-beams 3, 3A. As indicated, a number of shafts 4 for guiding warp yarns 30 and for shedding are disposed between the uprights 1, 2 in known manner. Also, a weft package 5 is disposed outside the shed from which a weft yarn can be drawn off and picked, for example by compressed air, a projectile, grippers, or the like, and beaten up at a shed apex into a cloth 6 as is well-known. The cloth 6 is taken up on a cloth beam 7 disposed between the uprights 1, 2.

The cross-beam 3 extends substantially over the weaving width of the loom above the shed while the second cross-beam 3*a*, i.e. a so-called "breast traverse", interconnects the cloth-side end parts of the uprights 1, 2. As indicated in FIG. 4, the upper cross-beam 3 may have a hollow square cross section.

Figure 2:
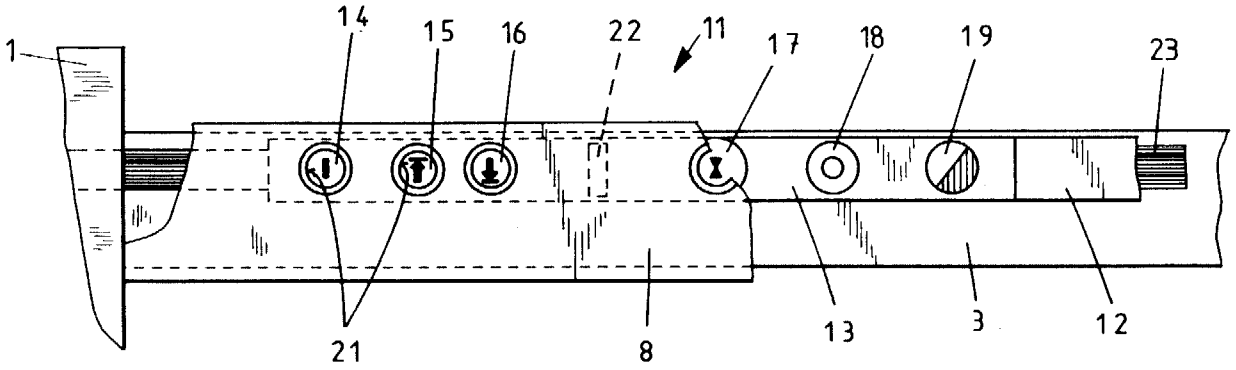
FIG. 2 illustrates a partial view of a guide member constructed in accordance with the invention.
Figure 4:
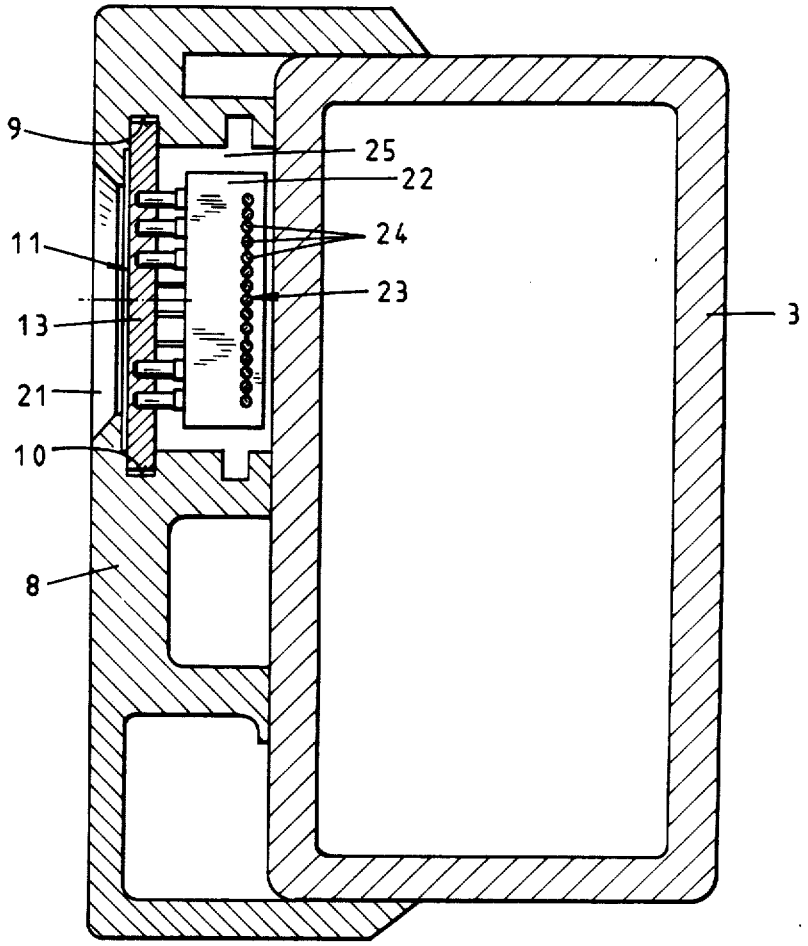
FIG. 4 illustrates a cross sectional view taken on line IV—IV of FIG. 1.

Referring to FIGS. 2 and 4, the mounting arrangement includes a bar-like guide member in the form of a retaining bar 8 which extends substantially over the weaving width and is mounted on the side of the cross beam 3 which is remote from the shafts 4. The retaining bar 8 may be made, for example of light metal and may be secured in a suitable manner, for example by screwing or clamping to the cross beam 3. As indicated in FIG. 4, the bar 8 is formed with a pair of oppositely disposed parallel guide grooves 9, 10 which extend substantially over the whole length of the bar 8 and, thus, the cross beam 3.

As indicated in FIG. 1, a plurality, for example three, switching units 11, 11*a*, 11*b* are displaceably guided within the guide member 8 over the length of the guide member 8. In addition, means, in the form of panel-like spacing members 12 are located in alternating relation with the switching units within the guide member 8 for locating the switching units.

Figure 3:
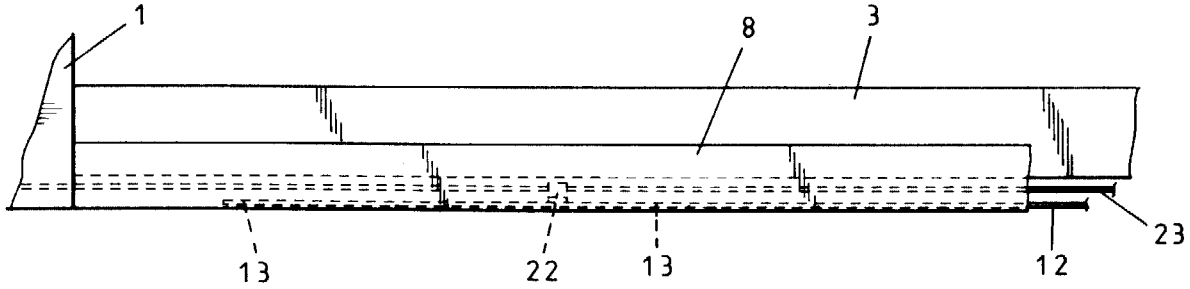
FIG. 3 illustrates a plan view of the mounting arrangement of FIG. 2.

As indicated in FIGS. 2 to 4, each switching unit 11, 11*a*, 11*b* is in the form of a printed circuit board 13 having a plurality of control elements in the form of integrated connections and switches 14, 15, 16, 17, 18, 19. These switches 14, 19 can be snap dome switches which project very little, if at all, beyond the fitting surface of the particular printed board 13 concerned.

The boards 13 and spacing elements 12 are each guided displaceably in the grooves 9, 10 parallel to the cross beam length by way of two opposed edges which act as retaining parts.

As indicated in FIG. 4, the retaining bar 8 has a front wall provided with a plurality of access openings 21 which provide access to the switches 14, 19. These access openings 21 are disposed in positions at which the switches 14, 19 are to be fitted.

In the construction illustrated, at least one of the switching units 11, 11*a*, 11*b* is accessible for an operative to start or stop the loom substantially from every part of the weaving width so that clearing faults, particularly yarn or weft breakages, requires correspondingly short loom down times. In each unit 11, 11*a*, 11*b*, the switch 14 serves to start the loom, the switches 15, 16, 17, respectively serve for backwards and forwards inching of the loom, the switch 17 for synchronization of the facilities coupled with the loom drive and the switch 18 for stopping the loom. The switch 19 can be part of a "two-hand interlock" and must be operated simultaneously with the switch 14 or 15 or 16 to release a safety interlocking of the switches 14, 15, 16. This feature ensures that when the loom starts, both hands of the operative remain clear of the moving parts of the loom.

Referring to FIGS. 2 and 4, the panels 13 are each connected by way of a connecting element in the form of a plug 22 to a connecting cable in the form of a flat strip cable 23 comprised of a number of control lines 24. These control lines 24 are connected to a control means or facility 26 (see FIG. 1) associated with a loom drive system 27. The drive system 27 can be acted upon by way of the lines 24 by each of the switching units 11, 11*a*, 11*b*. As indicated in FIG. 4, the cable 23 extends through a fitting or assembly space 25 between the cross beam 3 and the switching units 11, 11*a*, 11*b*. The cable 23 is also connected to the control facility 26 in a suitable manner (not shown).

In order to utilize the mounting arrangement, the switching units 11, 11*a*, 11*b* and the spacing elements 12 are each introduced into the guide grooves 9, 10 at one end of the retaining bar 8 prior to mounting of the bar 8 on the cross beam 3. Each switching unit is then moved along the retaining bar 8 into an operative position and secured in that position by a spacing element 12 without further securing means. The switching unit is then connected in a simple manner to a plug 22. After positioning of each switching element and the respective spacing elements, and after connection to the plugs 22, the retaining bar 8 can then be secured to the cross beam 3 in the operative position illustrated. As an alternative, the retaining bar 8 may remain on the cross beam 3 and be fitted with the switching units 11, 11*a*, 11*b*.

Figure 5:
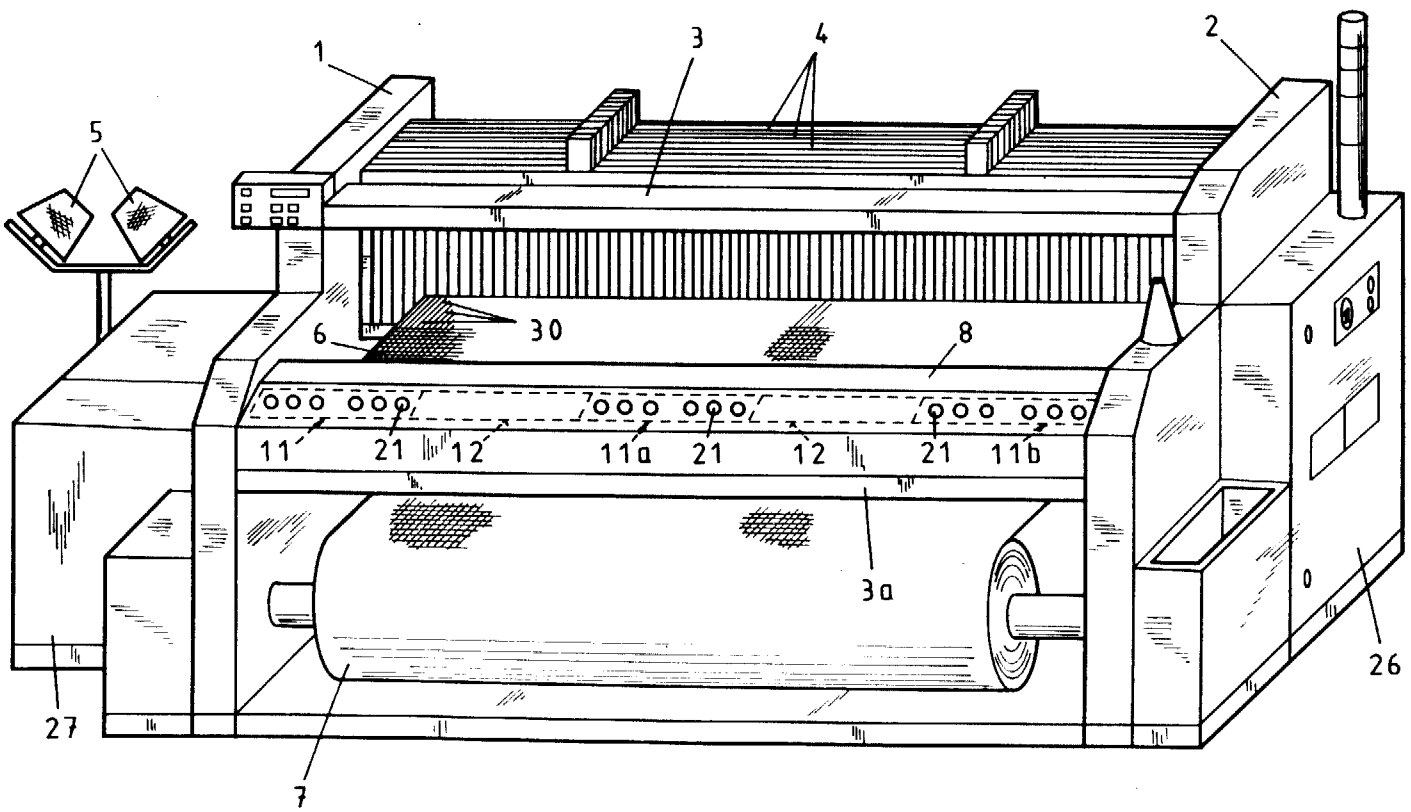
FIG. 5 illustrates a modified mounting arrangement in accordance with the invention.

Referring to FIG. 5, the cross beam 3*a* of the loom may also be provided with a retaining bar 8 of corresponding construction.

The retaining bar 8 may be of one-part construction as shown or may be made in two or more parts. Depending upon the weaving width of the loom, the bar 8 can be provided with more or less than three switching units, for example, the retaining bar 8 may have a single central switching unit possibly amplifying, for example two switching systems disposed on the uprights 1, 2.

The retaining bar 8 may also be in the form of an appropriate plastics section member instead of a light metal section member.

Alternatively, the grooves for the switching units 11, 11*a*, 11*b* may be integral with the cross beam and for the cross beam to be formed with access apertures or recesses for the switches 14, 19 or corresponding control or circuit elements. The grooves may also be disposed on the outside of the cross beam.

Alternatively, the switching units may be guided by way of corresponding grooves which extend transversely to the cross beam length, for example, vertically and which enable the switching units to be introduced from the top into the appropriate operating position.

The invention thus provides a mounting arrangement for the switching units for controlling a drive system of a loom which is of simple construction. Further, the mounting arrangement permits a plurality of switching units to be readily mounted on a cross beam of a loom in a relatively simple economical manner.

Further, the sliding arrangement of the switching units in the retaining bar permits the units to be readily moved into a selected operative position.

What is claimed is:

1. In a loom, the combination comprising a drive system;

a cross-beam extending over a weaving width of the loom;

at least one bar-like guide member mounted on said cross-beam;

at least one switching unit displaceably guided within said guide member and having a plurality of control elements connected to said drive system for controlling the loom; and means for locating said switching unit within said guide member.

2. The combination as set forth in claim 1 wherein said guide member is a retaining bar releasably mounted on said cross-beam.

3. The combination as set forth in claim 1 wherein said guide member has a pair of oppositely disposed parallel guide grooves receiving said switching unit in slidable relation and extending over at least some of the weaving width of the loom.

4. The combination as set forth in claim 3 wherein said means for locating said switching unit includes at least one spacing element slidably mounted in said grooves and abutting said switching unit.

5. The combination as set forth in claim 1 which further comprises a connecting cable extending along said cross-beam within a fitting space between said cross-beam and said switching unit and connected to said drive system and a connecting element connecting said switching unit to said cable.

6. The combination as set forth in claim 1 wherein said switching unit comprises a printed circuit board and said control elements are switches.

7. The combination as set forth in claim 1 wherein said guide member has at least one access opening to provide access to said control elements.

8. A mounting arrangement comprising a guide member for mounting on a cross-beam of a loom;

at least one switching unit displaceably guided within said guide member and having a plurality of control elements therein for controlling the loom; and means for locating said switching unit within said guide member.

9. A mounting arrangement as set forth in claim 8 wherein said guide member has a pair of oppositely disposed parallel guide grooves receiving said switching unit in slidable relation.

10. A mounting arrangement as set forth in claim 9 wherein said means for locating said switching unit includes at least one spacing element slidably mounted in said grooves and abutting said switching unit.

11. A mounting arrangement as set forth in claim 8 wherein said switching unit comprises a printed circuit board and said control elements are switches.

12. A mounting arrangement as set forth in claim 8 wherein said guide member has at least one access opening to provide access to said control elements.

13. A mounting arrangement as set forth in claim 8 comprising a plurality of said switching units spaced longitudinally along and within said guide member.

14. A method of mounting a switching unit having control elements for a drive system on a loom comprising the steps of mounting the switching unit in a guide member extending over a weaving width of the loom;

moving the switching unit along the guide member into an operative position;

securing the switching unit in said operative position;

connecting the switching unit to the drive system; and mounting the guide member on a cross-beam of the loom.

* * * * *

UNITED STATES PATENT AND TRADEMARK OFFICE

CERTIFICATE OF CORRECTION

PATENT NO. : 4,706,714

DATED : November 17, 1987

INVENTOR(S) : Bernhard Scharer

It is certified that error appears in the above-identified patent and that said Letters Patent is hereby corrected as shown below:

In the Abstract, line 3 change "acess " to -access-
Column 2, line 64 change "14, 19 to -14-19-
Column 3, line 5 change "14, 19 to -14-19-
Column 3, line 7 change "14, 19 to -14-19-
Column 3, line 68 change "14, 19 to -14-19-

Signed and Sealed this

Seventh Day of June, 1988

*Attest:*

*Attesting Officer*

DONALD J. QUIGG

*Commissioner of Patents and Trademarks*